US006289199B1

(12) United States Patent
Fujiwara

(10) Patent No.: US 6,289,199 B1
(45) Date of Patent: Sep. 11, 2001

(54) IMAGE FORMING APPARATUS PROVIDED WITH SEPARATION MEMBER TO WHICH AC VOLTAGE IS APPLIED

(75) Inventor: Motohiro Fujiwara, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/389,451

(22) Filed: Sep. 3, 1999

(30) Foreign Application Priority Data

Sep. 7, 1998 (JP) ..... 10-252317

(51) Int. Cl.[7] ..... G03G 15/00
(52) U.S. Cl. ..... 399/398; 399/315
(58) Field of Search ..... 399/398, 315, 399/349; 271/900, 307

(56) References Cited

U.S. PATENT DOCUMENTS 4,412,732 * 11/1983 Ogata et al. ..... 399/315
4,579,441 * 4/1986 Hart et al. ..... 399/315
4,739,363 4/1988 Hoshika et al. ..... 399/315
5,557,389 * 9/1996 Sato et al. ..... 399/315
5,621,513 * 4/1997 Pitts et al. ..... 399/398
5,943,530 * 8/1999 Ozasa ..... 399/398

FOREIGN PATENT DOCUMENTS 2 296 471 7/1996 (GB) .
59-125763 7/1984 (JP) .
2-96787 4/1990 (JP) .
3-118580 * 5/1991 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an image bearing body for bearing a toner image, a transfer device for transferring a toner image on an image bearing body to a transfer material, a separation member for separating a transfer material from the image bearing body by contacting with the image bearing body and a voltage applicator for applying a voltage having an AC component to the separation member.

4 Claims, 10 Drawing Sheets

IMAGE FORMING APPARATUS PROVIDED WITH SEPARATION MEMBER TO WHICH AC VOLTAGE IS APPLIED

BACKGROUND OF THE INVENTION

1. Field of the Invention

The present invention relates to an image forming apparatus of a copying machine, printer or the like using an electrophotographic system or an electrostatic recording system, particularly to an image forming apparatus having a separation member contacting with an image bearing body.

2. Related Background Art

FIG. 12 shows the above image forming apparatus. That is, FIG. 12 is a schematic block diagram of a conventional image forming apparatus. In FIG. 12, symbol (reference numeral) 1 denotes an image bearing body (amorphous silicon) for forming an electrostatic latent image, 2 denotes a primary charging device for electrifying the surface of the image bearing body 1, 3 denotes a laser beam for forming an electrostatic latent image on the image bearing body 1 by irradiating the image bearing body 1, 4 denotes a developing device for forming a toner image on the image bearing body 1 by applying a voltage between a developing sleeve 4*a* and the image bearing body 1 and developing an electrostatic latent image, 10 denotes a pre-transfer charging device for uniforming the charge of a toner image formed on the image bearing body 1, 8 denotes a transfer charging device for transferring a toner image formed on the image bearing body 1 to a transfer material 9, 5 and 6 denote first and second separation charging devices for separating the transfer material 9 from the image bearing body 1, 7 denotes a separation claw for separating the transfer material 9 which cannot be separated by the first separation charging device 5 and second separation charging device 6, 11 denotes a cleaning device for removing the toner (residual toner after transferring) with remains on the image bearing body 1 and is not transferred to the transfer material 9, and 12 denotes a semiconductor laser for emitting the laser beam 3 modulated by a image signal. The laser beam 3 is reflected by a rotational polygon mirror 14 to raster-scan the image bearing body 1 through a focusing lens 16 and a reflecting mirror 17.

Thus, an image forming apparatus having the above configuration makes it possible to obtain an image formed object by applying the image forming process including charging, optical image exposure, and development to the image bearing body 1 to form an image and then transferring the image to the transfer material 9, and fixing the transferred image in the transfer material 9.

In the case of the above conventional image forming apparatus, it is possible to securely separate the transfer material 9 from the image bearing body 1 by the separation claw 7 and thereby, preferable paper conveying causing no paper jam is realized. However, there are problems that residual toner attaches to the separation claw 7 and coheres and then, the cohered toner drips onto the transfer material 9 (hereafter referred to as dripping) and contaminates the image on the transfer material 9. FIG. 13 schematically shows the dripping state.

SUMMARY OF THE INVENTION

It is an object of the present invention to provide an image forming apparatus in which toner is not accumulated in a separation member.

It is another object of the present invention to provide an image forming apparatus comprising:

an image bearing body for bearing a toner image;

transfer means for transferring a toner image on an image bearing body to a transfer material;

a separation member for separating a transfer material from the image bearing body by contacting with the image bearing body; and voltage applying means for applying a voltage having an AC component to the separation member.

The other objects will become more apparent from the following description.

DETAILED DESCRIPTION OF THE PREFERRED EMBODIMENTS

Embodiments of the present invention will be described below by referring to the accompanying drawings.

<Embodiment 1>

Figure 1:
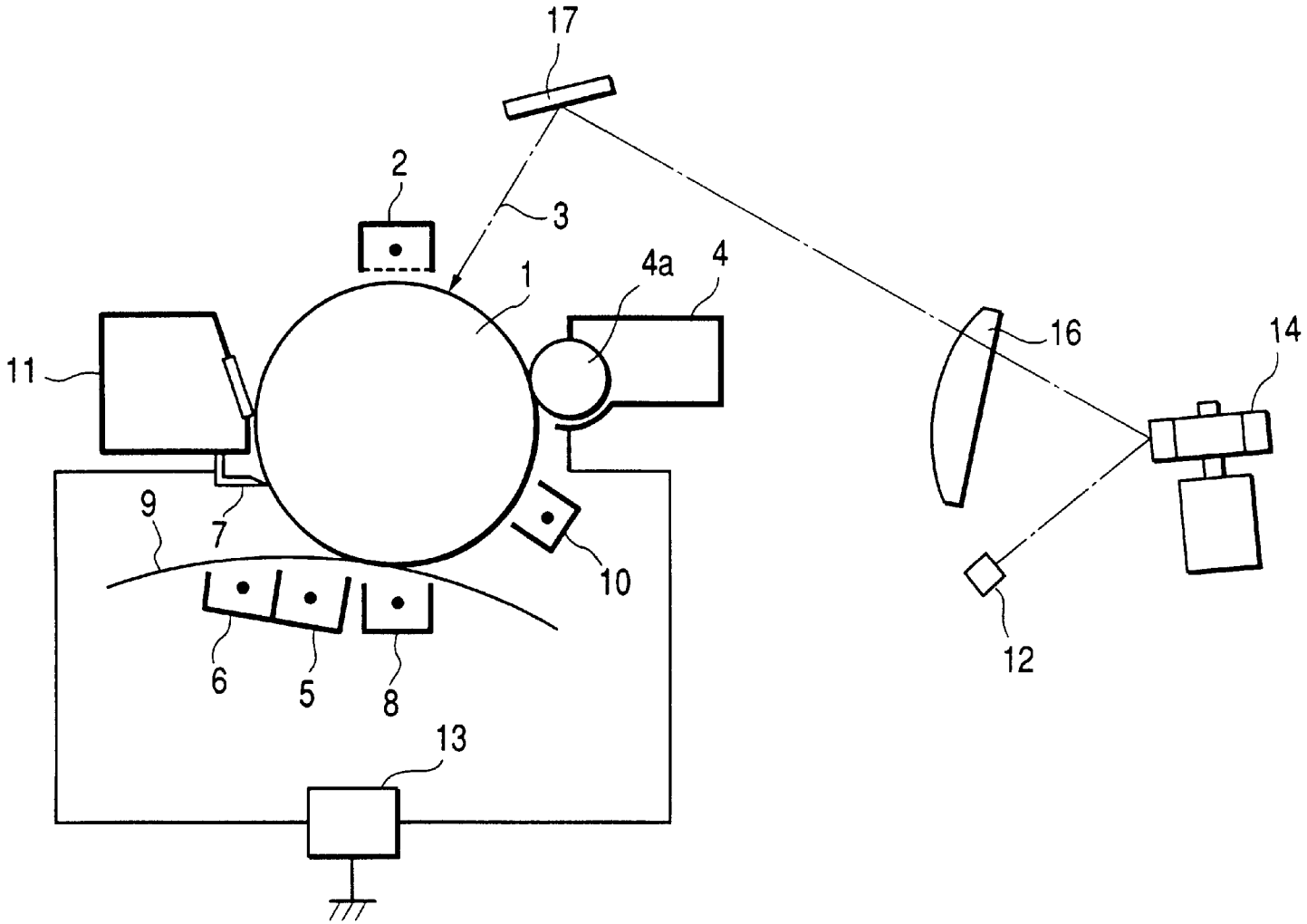
FIG. 1 is a schematic block diagram of the image forming apparatus of embodiment 1 of the present invention.

FIG. 1 is a schematic block diagram of an image forming apparatus of the present invention, in which symbol 1 denotes an image bearing body (amorphous silicon) for forming an electrostatic latent image, 2 denotes a primary charging device for charging the surface of the image bearing body 1, 3 denotes a laser beam for forming an electrostatic latent image on the image bearing body 1 by irradiating the image bearing body 1, 4 denotes a developing device for forming a toner image on the image bearing body 1 by applying a voltage between a developing sleeve 4*a* and the image bearing body 1 and developing an electrostatic latent image, 10 denotes a pre-transfer charging device for uniforming the charge of a toner image formed on the image bearing body 1, 8 denotes a transfer charging device for transferring a toner image formed on the image bearing body 1 to a transfer material 9, 5 and 6 denote first and second separation charging devices for separating the transfer material 9 from the image bearing body 1, 7 denotes a separation claw for separating the transfer material 9 which cannot be separated by the first separation charging device 5 and second separation charging device 6, 13 denotes a separation-claw voltage applying device for applying a voltage to the separation claw 7, 11 denotes a cleaner for removing the toner (residual toner after transferring) which remains on the image bearing body 1 and is not transferred to the transfer material 9, and 12 denotes a semiconductor laser for emitting the laser beam 3 modulated by a image signal. The laser beam 3 is reflected by a rotational polygon mirror 14 to raster-scan the image bearing body 1 through a focusing lens 16 and a reflecting mirror 17.

Then, some of functions of an image forming apparatus will be described below.

Figure 2A:
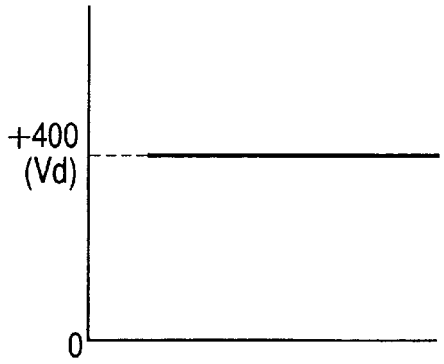
FIGS. 2A, 2B, 2C, 2D and 2E are illustrations showing potentials of the surface of an image bearing body and a transfer material of the image forming apparatus of the embodiment 1 of the present invention.
Figure 2B:
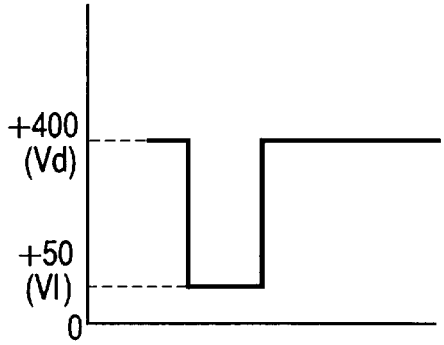

The image bearing body 1 is uniformly charged to +400 V (Vd) by the primary charging device 2 as shown in FIG. 2A and an electrostatic latent image of +50 V (V1) is formed by irradiation of the laser beam 3 as shown in FIG. 2B. In this case, Vd denotes a potential charged by the primary charging device 2 and V1 denoting a potential decayed due to irradiation of the laser beam 3.

Figure 2C:
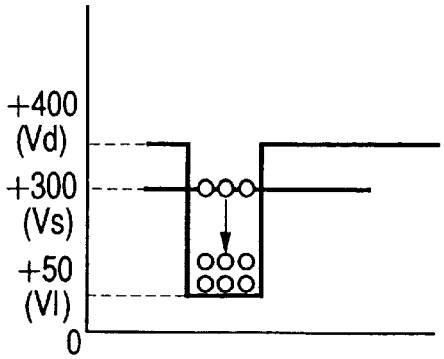

Moreover, by applying a DC voltage Vs to the developing sleeve 4*a* of the developing device 4, an electrostatic latent image is reversal-developed by positively-charged toner and a toner image is formed as shown in FIG. 2C. Though it is ideal that all toner is positively charged, there is some toner that is negatively charged in fact. The negatively-charged toner is developed by a +400-V potential section. Moreover, the charge of the toner is almost uniformed by the pre-transfer charging device 10.

Figure 2D:
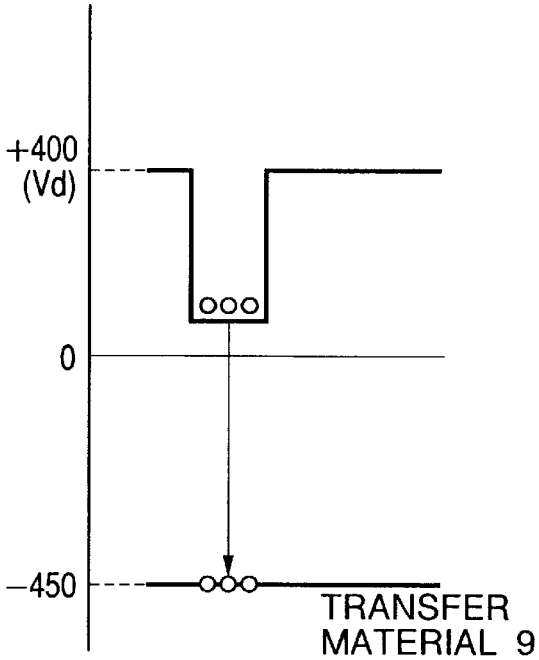
Figure 2E:
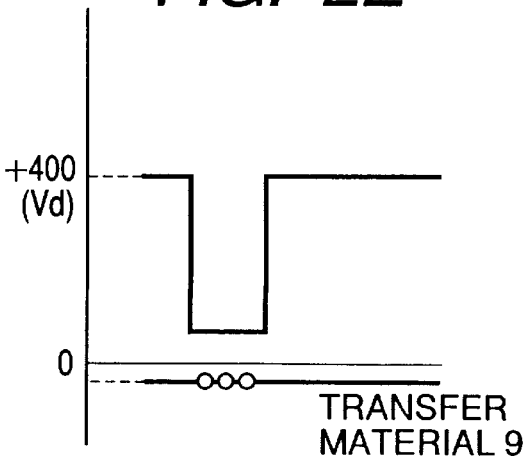

Thus, negative electric charges are provided for the back surface of the transfer material 9 by the transfer charging device 8, the back surface potential of the transfer material 9 becomes −450 V as shown in FIG. 2D, and a toner image is transferred to the transfer material 9. Then, unnecessary negative electric charges provided for the back of the transfer material 9 are removed by the separation charging devices 5 and 6, the potential of the transfer material 9 becomes about 0 V as shown in FIG. 2E, the adsorbing force between the transfer material 9 and the image bearing body 1 is weakened, the transfer material 9 is preferably separated from the image bearing body 1, and a desired image can be formed on the transfer material 9.

Figure 3:
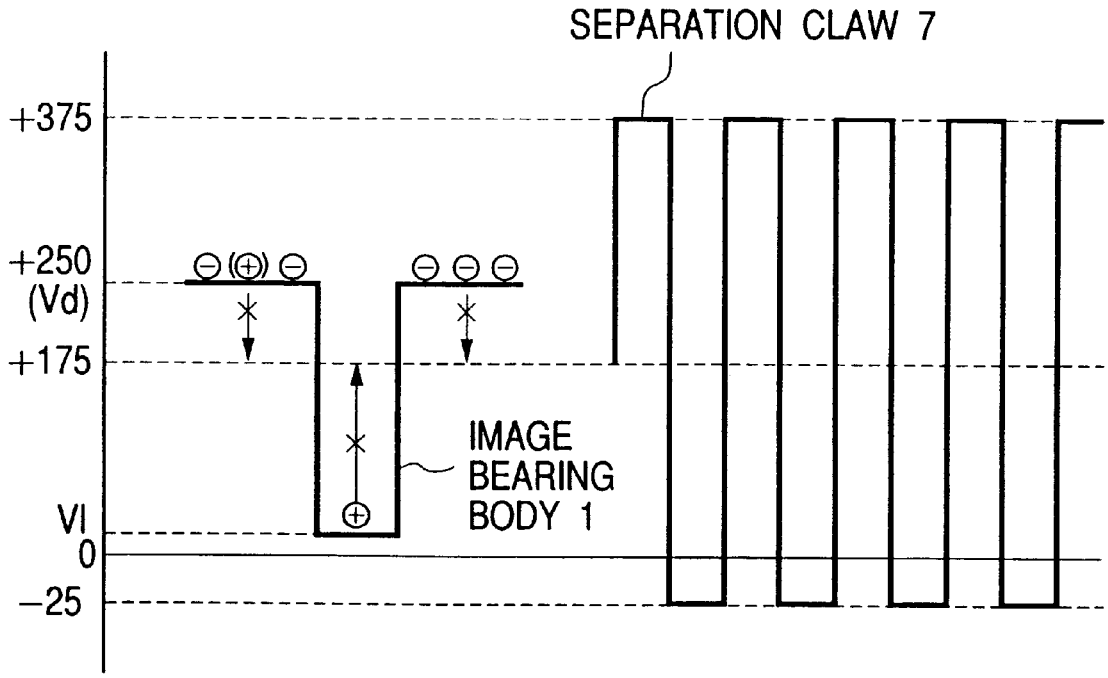
FIG. 3 is an illustration showing potentials of the surface of an image bearing body and a separation claw of the image forming apparatus of the embodiment 1 of the present invention at the position of the separation claw.

FIG. 3 shows the potential of the image bearing body 1 at the position of the separation claw 7. The above functions are simplified for explanation and every potential is shown by converting it into the value at the developing position 4. In fact, potentials are lowered due to dark decay as time passes (that is, toward the downstream side along the rotational direction of the image bearing body 1). Therefore, Vd in FIG. 3 is equal to 250 V and V1 in FIG. 3 is equal to about 0 V and they are smaller than the values shown in FIGS. 2A, 2B, 2C, 2D and 2E. Moreover, residual toner after transferring is present on the image bearing body 1 at the position of the separation claw 7, which is also shown in FIGS. 2A, 2B, 2C, 2D and 2E together with an charged polarity. Because most of residual toner after transferring is toner not transferred, most of it is negatively-charging toner attached to Vd. Moreover, the voltage applied to the separation claw 7 is shown.

Thus, a component obtained by superposing (superimposing) a DC component 175 V on a rectangular AC at an amplitude of 400 V and a frequency of 2.7 kHz is applied to the separation claw 7 by the separation-claw voltage applying device 13. This is because of setting the potential of the separation claw 7 to a value between Vd and V1 at the position of the separation claw 7. Thereby, the negative-electric-charge toner attached to Vd and positive-electric-charge toner attached to V1 are not attached to the separation claw 7 due to the force of an electric field.

Figure 4A:
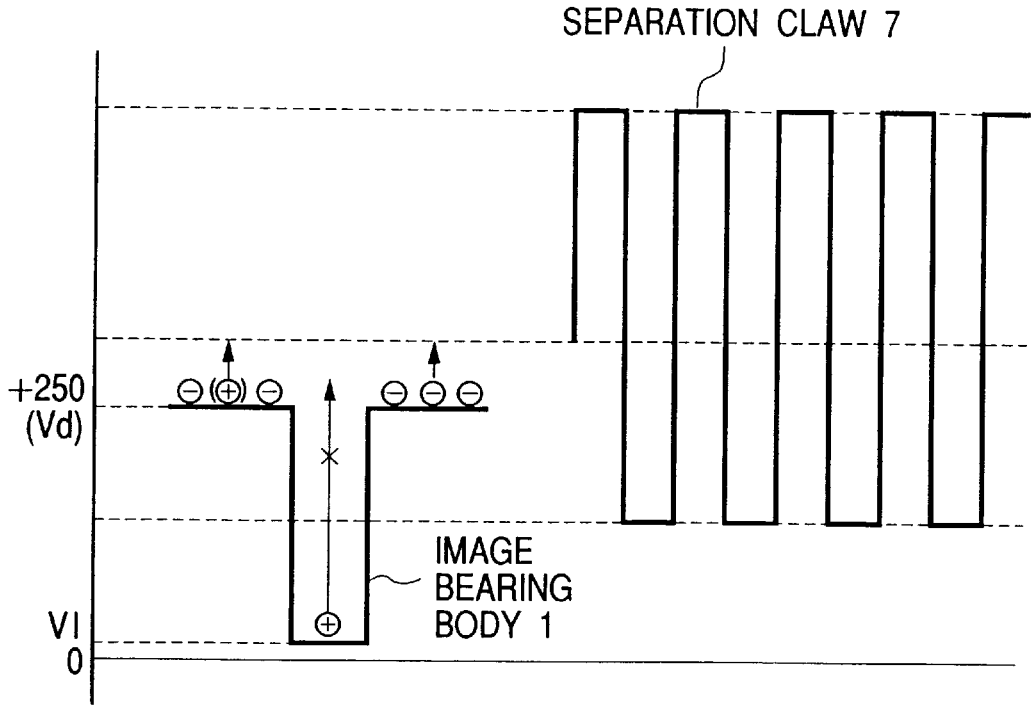
FIGS. 4A and 4B are illustrations showing potentials of the surface of an image bearing body and a separation claw at the position of the separation claw when the potential of the separation claw is different from that of the present invention.
Figure 4B:
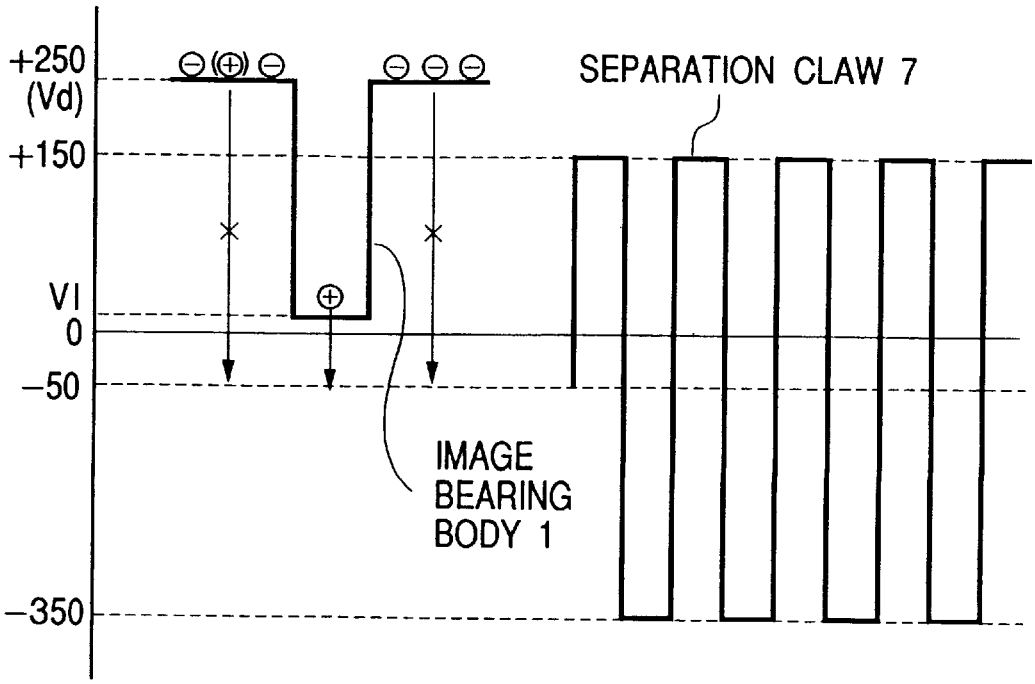

However, because the electric-field force is still insufficient, some of the toner intercepted by the separation claw attaches to the separation claw 7 and drips. Therefore, AC is superimposed because it is necessary to increase the intensity of the electric field without changing directions of the electric field. By superimposing AC as described above, a strong electric field is applied in a very short time though an average electric field is not strengthened in a long time. As a result, toner accurately moves for an electric field and thereby, the toner moves to the image bearing body 1, the amount of toner to be attached to the separation claw 7 decreases, and thus no toner drips. Particularly, applying an AC duty is further preferable because it is possible to effectively apply a strong electric field. However, if a DC applied voltage is greatly higher than Vd as shown in FIG. 4A or greatly lower than V1 as shown in FIG. 4B, residual toner after transferring attaches to the separation claw 7 and when the residual toner after transferring attaches up to a certain quantity and coheres, dripping occurs. However, when the DC voltage is kept at a value close to Vd or V1 or between Vd and V1, dripping does not occur.

Then, the configuration of the separation claw is described below by referring to FIG. 5.

Figure 5:
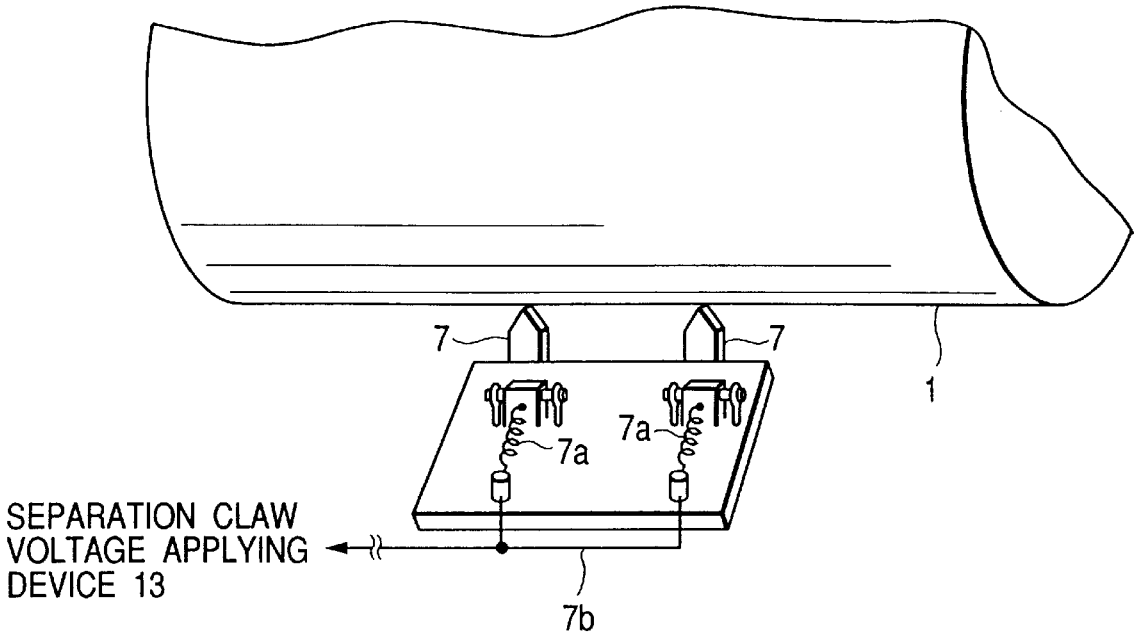
FIG. 5 is a perspective view showing the configuration of a separation claw and its circumference of the image forming apparatus of the embodiment 1 of the present invention.

FIG. 5 is a perspective view showing the configuration of the separation claw 7 and its circumference, in which the separation claw 7 contacts the image bearing body 1 by being pressed against the body 1 at a proper pressure. Moreover, the separation claw 7 is provided with a separation-claw pressing spring 7*a* and the above proper pressure is obtained by the separation-claw pressing spring 7*a*. The separation-claw pressing spring 7*a* is made of SUS that is a conductive material and is electrically connected to the separation-claw voltage applying device 13 to via a conductive wire 7*b*.

This embodiment uses polyamide-imide as the material of the separation claw 7. In this case, it is possible to use any substance as the material of the separation claw 7 as long as the substance is not easily broken due to collision with the transfer material 9 or it does not damage the image bearing body 1. Therefore, it is also possible to use polyether imide and the like. Moreover, the separation claw 7 is coated with carbon in order to secure the conductivity of the surface of the separation claw 7. It is also permitted to coat the claw 7 with any other material as long as the material is a conductive substance. Furthermore, it is permitted to use a conductive material for the claw 7. In any case, it is preferable to secure the conductivity of the surface of the separation claw 7 to a certain extent. The separation claw 7 used for this embodiment has a surface resistance of 20 kΩ.

Then, the separation-claw voltage applying device 13 will be described below.

Figure 6:
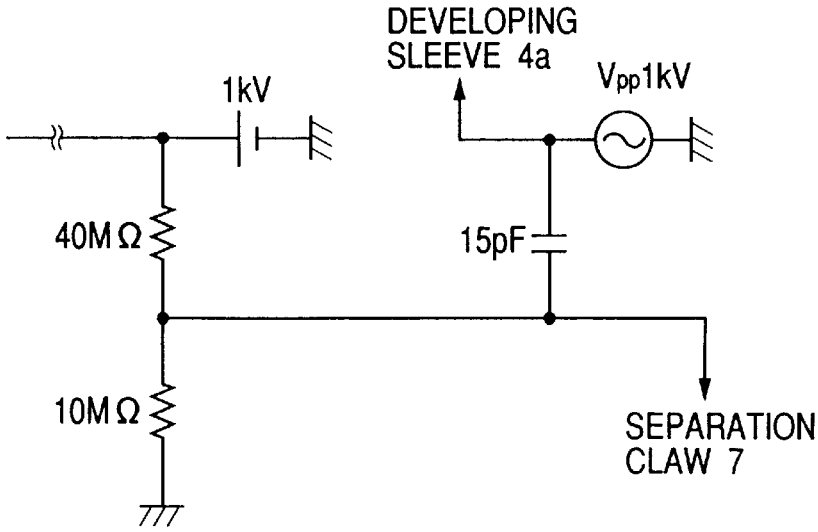
FIG. 6 is a circuit block diagram of a separation-claw voltage applying device of the image forming apparatus of the embodiment 1 of the present invention.

FIG. 6 shows a schematic circuit diagram of the separation-claw voltage applying device 13. This circuit generates a voltage to be applied to the separation claw 7 by branching the voltage to be applied to the developing sleeve 4*a*. By branching the voltage to be applied to the developing sleeve 4*a* and applying it to the separation claw 7, the configuration of the separation-claw voltage applying device 13 is simplified and an image forming apparatus can be reduced in cost and size.

However, by applying a voltage to the separation claw 7, a problem occurs that excessive current flows from the separation claw 7 to the image bearing body 1 and thereby, the image bearing body 1 is damaged to cause an image defect. The image defect easily occurs when a voltage is applied to the separation claw 7 when the image bearing body 1 stops. Therefore, it is necessary to apply a voltage to the separation claw 7 only when the image bearing body 1 rotates. It is preferable to apply a voltage to the separation claw 7 only when toner is supplied. Therefore, in the case of this embodiment, a voltage is applied to the separation claw 7 only when toner is supplied to the claw 7 by synchronizing the voltage to be applied to the claw 7 with a voltage to be applied to the developing sleeve 4*a*.

Though the present invention can be applied to any toner, this embodiment uses one-component magnetic positive toner. One-component magnetic toner has advantages that replacement of agents is unnecessary and the toner does not easily scatter but it has disadvantages that electrification of the toner is difficult and the toner is ununiform. The disadvantages are caused by the fact that the toner has magnetism and is insufficient in electrification force due to the fact that there is no carrier. When electrification is ununiform (particularly when the toner is charged into reverse polarity or a part of the toner is charging into reverse polarity), particles of the toner easily attach to each other because reverse polarities have adsorbing force and easily cohere. Particularly, positive toner easily becomes ununiform because there are only a few resins that can be used as binder. Therefore, a method for embedding an electric-charge control agent in a binder resin is frequently used for positive toner. However, because an electriccharge control agent is rarely uniformly embedded in a binder, negatively charged portion and positively charged portion are easily present in one type of toner. Therefore, positive toner tends to easily cohere. Thus, one-component magnetic positive toner easily attaches to the separation claw 7 and coheres and easily drips. For this reason, it is very effective to apply the present invention to one-component magnetic positive toner.

Thus, according to this embodiment, it is possible to set the potential of the surface of the separation claw 7 to a desired value. As a result, it is possible to obtain a preferable image because toner does not attach to the separation claw 7, dripping does not occur, or an image on the transfer material 9 is not contaminated.

<Embodiment 2>

Then, embodiment 2 of the present invention will be described below by referring to FIGS. 7 and 8.

This embodiment uses only AC voltages as voltages to be applied to a separation claw 7 in a reverse developing system.

Figure 7:
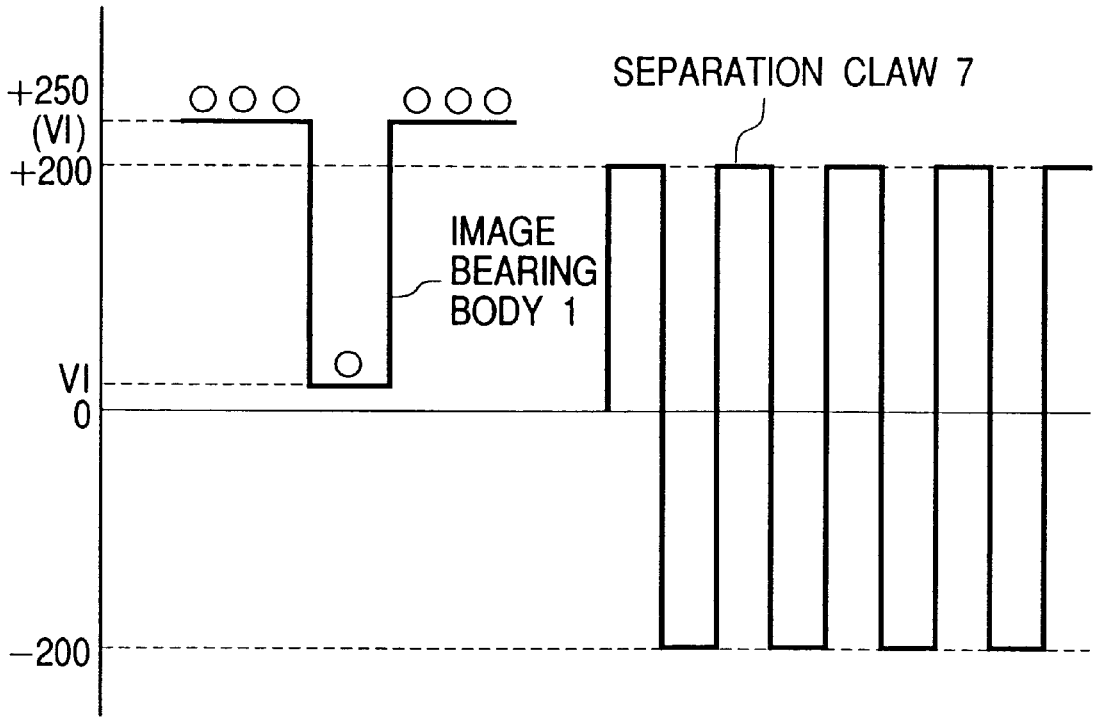
FIG. 7 is an illustration showing potentials of the surface of an image bearing body and a separation claw of the image forming apparatus of embodiment 2 of the present invention at the position of the separation claw.
Figure 8:
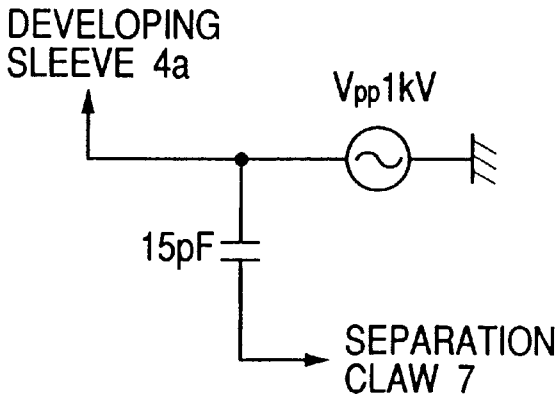
FIG. 8 is a circuit block diagram of a separation-claw voltage applying device of the image forming apparatus of the embodiment 2 of the present invention.

FIG. 7 is an illustration corresponding to FIG. 3, which shows a state of applying an AC voltage to the separation claw 7 in a reverse developing system.

As shown in FIG. 7, when setting the potential of the separation claw 7 to about 0 V, the negatively charged toner attached to Vd does not attach the separation claw 7 at all but the positively charged toner attached to V1 tends to slightly attach the separation claw 7 in an electric-field manner.

However, the quantity of the positively charged toner attached to V1 is very small because electric field is almost zero since V1 is almost equal to 0 V and the toner is almost transferred to a transfer material 9. Therefore, even if the potential of the separation claw 7 is set to about 0 V, a sufficient effect is obtained because no toner attaches the separation claw 7. In case of a normal developing system, however, dripping occurs when setting the potential of the separation claw 7 to about 0 V because there are many particles of negatively charged toner attached to V1.

It is most preferable to set the potential of the separation claw 7 to a value between Vd and Vl as described for the embodiment 1. However, by applying only AC voltages to the separation claw 7, it is possible to constitute the separation-claw voltage applying device 13 into the circuit shown in FIG. 8 and simplify the device 13 compared to the circuit shown in FIG. 6. Therefore, it is possible to cut the cost and downsize an image forming apparatus.

<Embodiment 3>

Then, embodiment 3 of the present invention will be described below by referring to FIGS. 9 to 11.

This embodiment changes DC voltages to be applied to a separation claw 7 in accordance with the change of Vd or V1. Vd or V1 may be changed in accordance with environment, a transfer material 9, type of image, mode or the like. In this case, DC voltages to be applied to the separation claw 7 are changed. This embodiment uses a configuration in which a user can change a mode to a toner consumption reducing mode.

Figure 9:
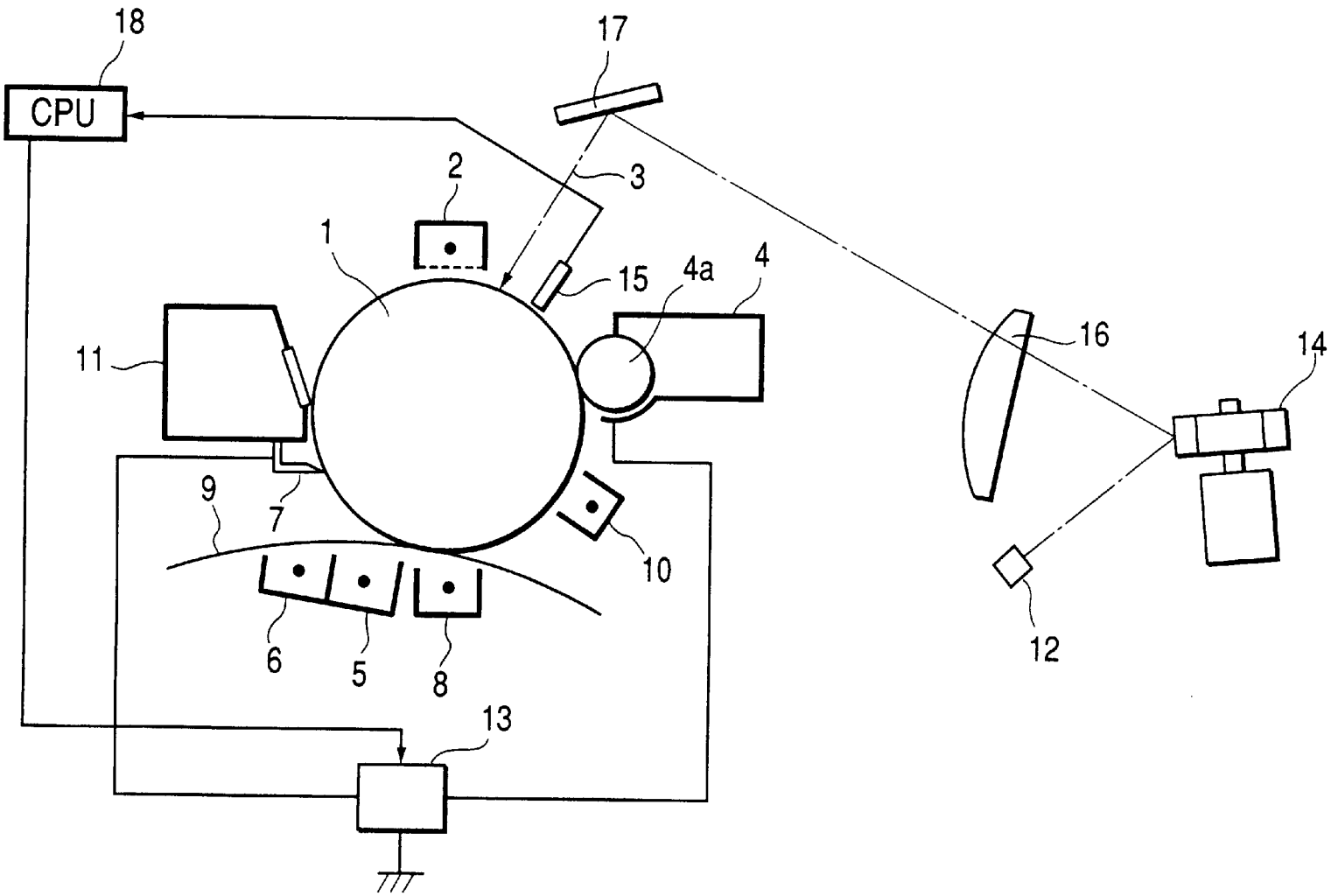
FIG. 9 is a schematic block diagram of the image forming apparatus of embodiment 3 of the present invention.
Figure 10A:
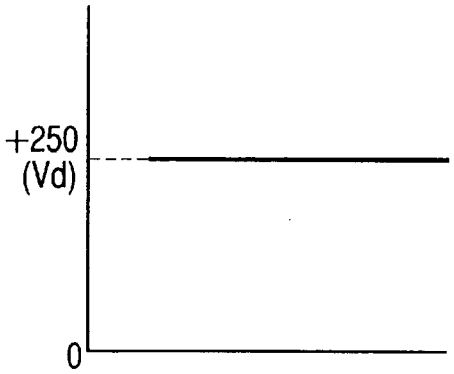
FIGS. 10A, 10B, 10C, 10D and 10E are illustrations showing potentials of the surface of an image bearing body and a separation claw of the image forming apparatus of the embodiment 3 of the present invention.
Figure 10B:
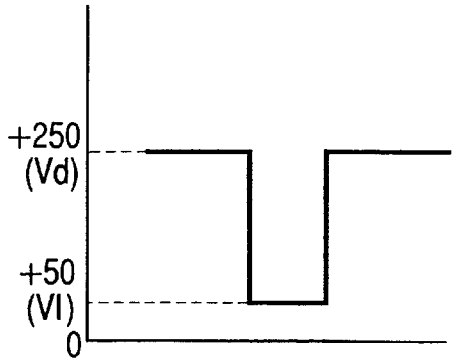
Figure 10C:
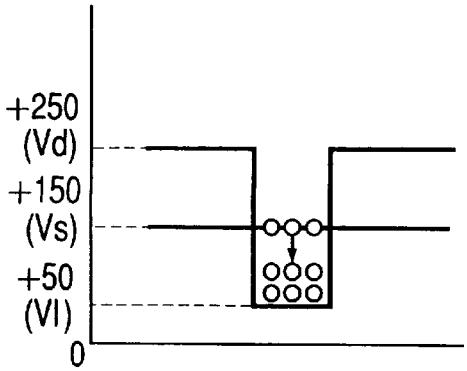
Figure 10D:
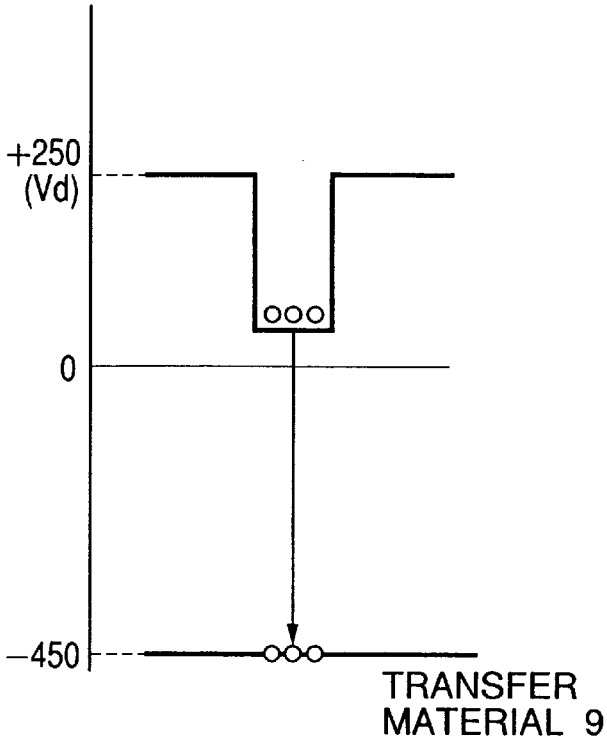
Figure 10E:
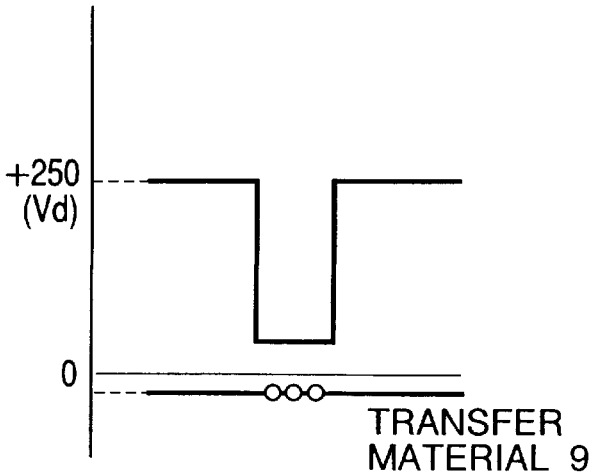

FIG. 9 is a schematic block diagram of the image forming apparatus of this embodiment. In FIG. 9, components same as those shown in FIG. 1 are provided with the same symbol and hereafter, description of the components is omitted. The image forming apparatus of this embodiment is different from the image forming apparatus of the embodiment 1 shown in FIG. 1 in that an electrometer 15 for measuring Vd and Vi is included and a CPU 18 for deciding an optimum DC voltage to be applied to the separation claw 7 by obtaining Vd or V1 at the position of the separation claw 7 from a detection result of the electrometer 15 is included.

Then, functions of the image forming apparatus of this embodiment are described below by referring to FIGS. 10A, 10B, 10C, 10D and 10E. Because functions of the image forming apparatus of this embodiment are almost the same as those of the image forming apparatus of the embodiment 1, their detailed description is omitted. However, this embodiment is different from the embodiment 1 (FIGS. 2A, 2B, 2C, 2D, and 2E) in that Vd is set to 250 V in order to reduce toner consumption and thereby, a voltage Vs to be applied to a developing sleeve 4*a* is set to 150 V.

It is permitted to measure Vd and V1 at any time or in a certain time while an image is formed and moreover, it is permitted to measure Vd and V1 only when changing Vd and V1 and thereafter use a fixed value based on the measurement. Measurement of Vd and V1 when changing them can be performed immediately after changing Vd and V1, immediately before forming an image immediately after changing Vd and V1, or while forming an image. In the case of this embodiment, Vd and V1 are formed immediately before forming an image immediately after changing modes and measured by the electrometer 15. As a result, Vd shows 265 V and V1 shows 55 V.

To decide a voltage to be applied to the separation claw 7, it is necessary to obtain the voltage at the position of the separation claw 7 by considering dark decay of an image bearing body 1 in addition to measurement results of Vd and V1. However, because a dark decay value has a peculiar value every image bearing body 1, it is preferable to measure a dark decay value peculiar to the image bearing body 1 by using two electrometers 15 or more immediately before shipping an image forming apparatus. Though it is more preferable to always measure a dark decay value by setting one more electrometer 1 to a separate place, the cost is greatly increased. Simply, it is permitted to fix the dark decay value of the image bearing body 1 to a certain value by assuming that the value does not greatly depend on the fluctuation of the image bearing body 1. This embodiment uses a certain average value as the dark decay value of the image bearing body 1 by assuming the dark decay value does not depend on the fluctuation of the body 1.

Figure 11:
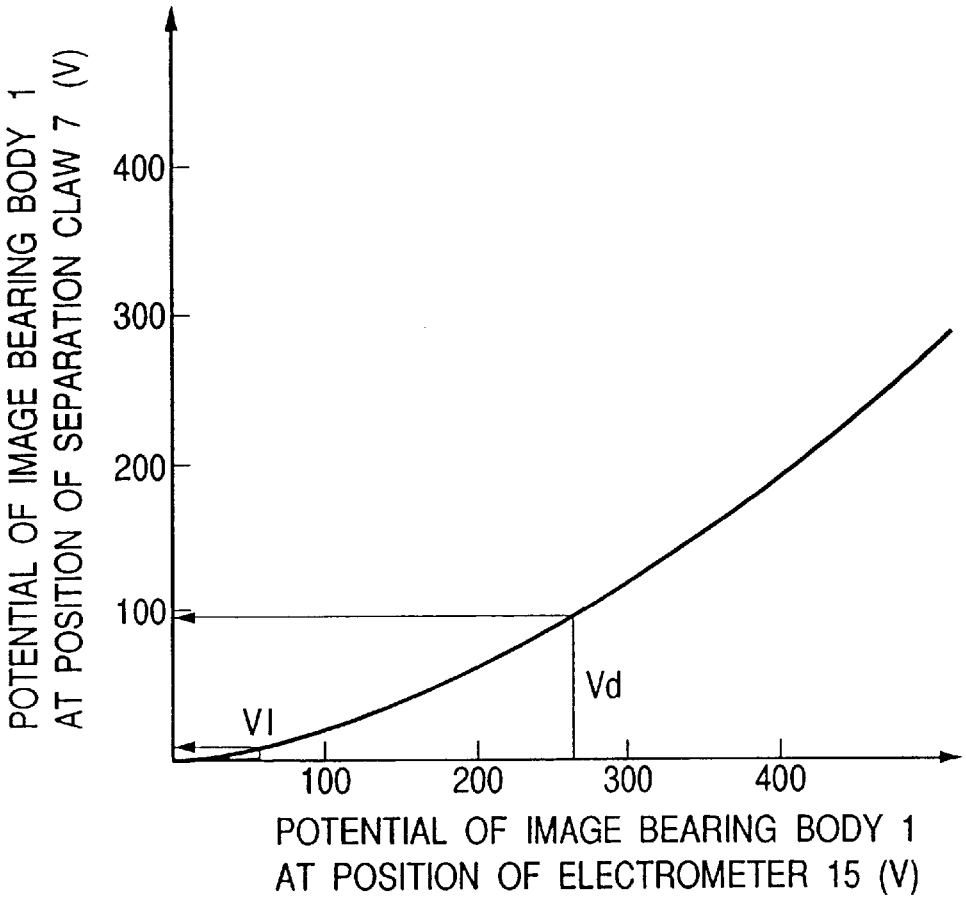
FIG. 11 is a dark-decay characteristic diagram of an image bearing body.
Figure 13:
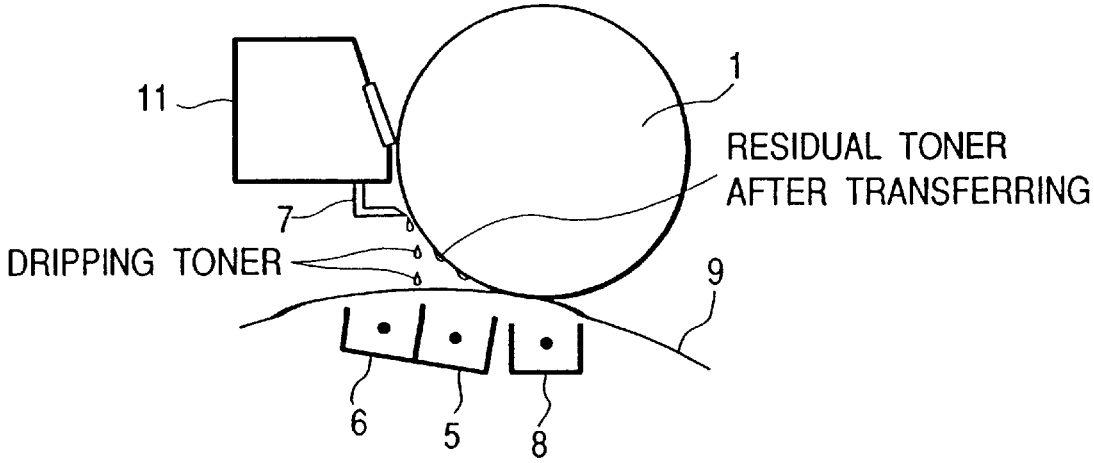
FIG. 13 (PRIOR ART)
FIG. 13 is a schematic view showing a state of dripping.
Figure 12:
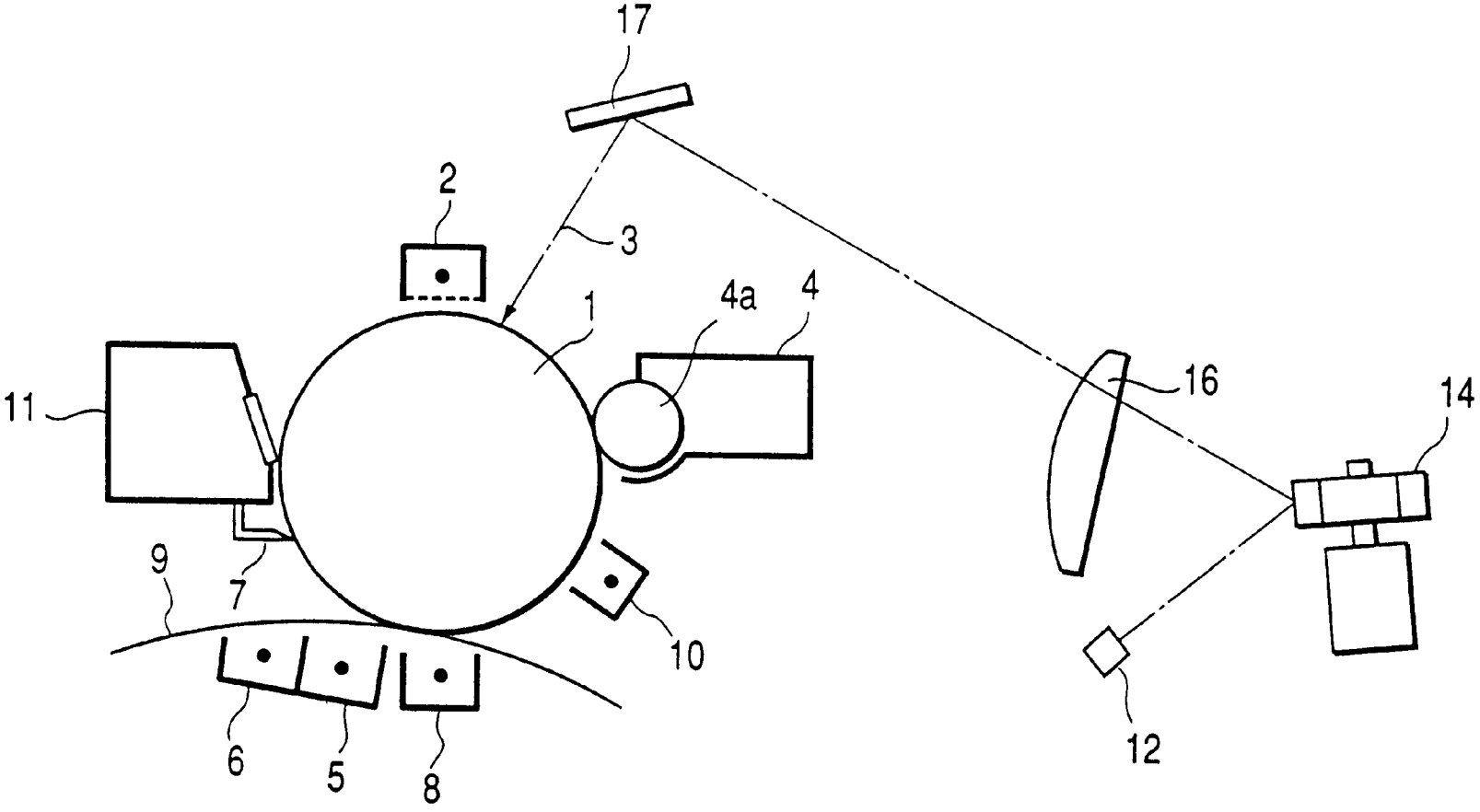
FIG. 12 (PRIOR ART)
FIG. 12 is a schematic block diagram of a conventional image forming apparatus.

FIG. 11 shows the dark decay characteristic used for this embodiment.

In FIG. 11, x-axis shows the potential of the image bearing body 1 at the position of the electrometer 15 and y-axis shows the potential of the image bearing body 1 at the position of the separation claw 7. FIG. 11 shows the average value of measurement results when setting an electrometer also to the position of the separation claw 7 in addition to the electrometer 15 and forming images by a plurality of image forming apparatuses. As for the potentials of the image bearing body 1 at the position of the separation claw 7 obtained from the characteristic curve shown in FIG. 11, Vd is equal to 95 V and V1 is equal to 5 V. Therefore, 50 V is applied to the separation claw 7 as a DC component. Even by changing Vd and V1 in accordance with environment, transfer material, type of image, mode or the like, it is possible to obtain a preferable image by preventing toner from attaching to the separation claw 7, dripping from being caused, and an image on a transfer material 9 from being contaminated.

In the case of this embodiment, it is possible to omit the electrometer 15 in order to cut the cost. In this case, the potential of the image bearing body 1 at the position of the separation claw 7 is obtained from the current flowing through a primary charging device 2, the current flowing through a laser beam 3 or the like.

As described above, the present invention makes it possible to prevent toner from attaching to a separation claw by applying a voltage obtained by superimposing AC on AC or DC to a separation claw and obtain a preferable image on a transfer material without contaminating the image by preventing dripping while securely separating a transfer material from an image bearing body by a separation claw.

Embodiments of the present invention were described above. However, the present invention is not restricted to the embodiments and every modification can be made within the technical concept.

What is claimed is:

1. An image forming apparatus comprising:

an image bearing body for bearing a toner image;

transfer means for transferring the toner image on said image bearing body to a transfer material;

a separation member for separating the transfer material from said image bearing body by contacting with said image bearing body; and voltage applying means for applying a voltage obtained by superposing an AC component on a DC component to said separation member;

wherein the DC component has a value between a maximum value and a minimum value of a potential at a contact portion of said separation member of said image bearing body.

2. An image forming apparatus according to claim 1, wherein said voltage applying means applies the voltage to said separation member only when said image bearing body rotates.

3. An image forming apparatus according to claim 1, wherein said voltage applying means applies a rectangular voltage.

4. An image forming apparatus comprising:

an image bearing body for bearing an electrostatic image;

developing means for developing an electrostatic latent image on said image bearing body with toner by using an alternating electric field;

transfer means for transferring a toner image on said image bearing body to a transfer material;

a separation member for separating the transfer material from said image bearing body by contacting with said image bearing body; and voltage applying means for applying a voltage having an AC component to said separation member;

wherein said voltage applying means applies the voltage generated by branching a voltage to be applied to said developing means.

* * * * *

UNITED STATES PATENT AND TRADEMARK OFFICE

CERTIFICATE OF CORRECTION

PATENT NO. : 6,289,199 B1
DATED : September 11, 2001
INVENTOR(S) : Motohiro Fujiwara It is certified that error appears in the above-identified patent and that said Letters Patent is hereby corrected as shown below:

Column 1,
Line 36, "with" should read -- which --.

Column 3,
Line 21, "a" should read -- an --.
Line 25, "Then, some" should read -- Some --.
Line 32, "denoting" should read -- denotes --.

Column 4,
Line 1, "an" should read -- a --.
Line 3, "negatively-charging" should read -- negatively-charged --.
Line 21, "is" should be deleted.
Line 36, "Then, the" should read -- The --.
Line 47, "to" should be deleted.
Line 64, "Then, the" should read -- The --.

Column 5,
Line 32, "charging" should read -- charged --.
Line 39, "electriccharge" should read -- electric-charge --.
Line 55, "Then, embodiment 2" should read -- Embodiment 2 --.
Lines 65 and 67, "the" should read -- to the --.

Column 6,
Line 6, "the" should read -- to the --.
Line 12, "V1" should read -- V1 --.
Line 20, "Then, embodiment 3" should read -- Embodiment 3 --.
Line 37, "Vi" should read -- V1 --.
Line 67, "peculiar" should read -- particular --.

UNITED STATES PATENT AND TRADEMARK OFFICE

CERTIFICATE OF CORRECTION

PATENT NO. : 6,289,199 B1
DATED : September 11, 2001
INVENTOR(S) : Motohiro Fujiwara It is certified that error appears in the above-identified patent and that said Letters Patent is hereby corrected as shown below:

Column 7,
Line 1, "every" should read -- each individual --.
Line 2, "peculiar to the" should read -- particular to each --.

Signed and Sealed this

Second Day of April, 2002

*Attest:*

*Attesting Officer*

JAMES E. ROGAN
*Director of the United States Patent and Trademark Office*